US005874924A

United States Patent [19]

Csongor et al.

[11] Patent Number: 5,874,924

[45] Date of Patent: Feb. 23, 1999

[54] SPACECRAFT ANTENNA ARRAY WITH DIRECTIVITY ENHANCING RINGS

[75] Inventors: Rezso Janos Csongor, Langhorne; Michael John Noyes, Yardley, both of Pa.

[73] Assignee: Lockheed Martin Corp., Sunnyvale, Calif.

[21] Appl. No.: 972,202

[22] Filed: Nov. 17, 1997

[51] Int. Cl.[6] ..... H01Q 1/22

[52] U.S. Cl. ..... 343/797; 343/789; 343/817; 343/DIG. 2

[58] Field of Search ..... 343/789, 797, 343/815, 817, 818, 819, 833, 912, DIG. 2; H01Q 1/22

[56] References Cited

U.S. PATENT DOCUMENTS

| | | | |
|---|---|---|---|
| 2,663,797 | 12/1953 | Kock | 343/797 |
| 3,740,754 | 6/1973 | Epis | 343/797 |
| 4,218,685 | 8/1980 | Ellis | 343/797 |
| 4,641,304 | 2/1987 | Raychaudhuri | 370/95 |
| 4,647,942 | 3/1987 | Counselman et al. | 343/797 |
| 4,688,213 | 8/1987 | Raychaudhuri | 370/93 |
| 4,862,187 | 8/1989 | Hom | 343/797 |
| 5,521,610 | 5/1996 | Rodal | 343/797 |
| 5,548,299 | 8/1996 | Tsuda et al. | 343/797 |

*Primary Examiner*—Don Wong
*Assistant Examiner*—Tho Phan
*Attorney, Agent, or Firm*—W. H. Meise; R. P. Kennedy

[57] ABSTRACT

An array antenna (12*atf*) particularly useful for a spacecraft includes a plurality of antenna elements (310). Each of the elements includes a conductive hexagonal cup (408) having sides (410*a*, 410*b*, 410*c*, . . .) which are thirteen twentieths of a wavelength long at the center frequency, and have a height above the bottom (412) which is a little more than one-third wavelength. A crossed dipole (420) includes two dipoles (420V, 420H), the first (421, 422) having elements approximately one quarter wavelength long, and the second (420H) having elements (423, 424) about three twentieths of a wavelength long. The plane of the crossed dipole is about one quarter wavelength above the bottom of the cup. A first director ring (512) has a diameter of about one quarter wavelength, and is spaced about nine tenths of a wavelength above the bottom. A second director ring (514) has a like diameter, and is spaced about seven tenths of a wavelength above the bottom of the cup. The director rings have a thickness measured axially which is about one hundredth of a wavelength. A mounting arrangement includes a dielectric tripod (522) transfixed by a dielectric cylinder (520), on which the director rings are mounted.

17 Claims, 9 Drawing Sheets

SPACECRAFT ANTENNA ARRAY WITH DIRECTIVITY ENHANCING RINGS

FIELD OF THE INVENTION

This invention relates to antennas, and more particularly to array antennas for use on spacecraft, and especially to such antennas as transduce circular or elliptical polarization.

BACKGROUND OF THE INVENTION

Many modern communication systems rely on spacecraft which are used as transponders. Mobile cellular communication systems have become of increasing importance, providing mobile users the security of being able to seek aid in case of trouble, allowing dispatching of delivery and other vehicles with little wasted time, and the like. Present cellular communication systems use terrestrial transmitters, such as towers, to define each cell of the system, so that the extent of a particular cellular communication system is limited by the region over which the towers are distributed. Many parts of the world are relatively inaccessible, or, as in the case of the ocean, do not lend themselves to location of a plurality of dispersed cellular sites.

In these regions of the world, spacecraft-based communication systems may be preferable to terrestrial-based systems. It is desirable that a spacecraft cellular communications system adhere, insofar as possible, to the standards which are common to terrestrial systems, and in particular to such systems as the GLOBAL SYSTEM FOR MOBILE COMMUNICATIONS system (GSM), which is in use in Europe.

The GSM system is a cellular communications system which communicates with user terminals by means of electromagnetic transmissions from, and receptions of such electromagnetic signals at, base stations, fixed sites or towers spaced across the countryside. The term "user terminal" for purposes of this patent application includes mobile user terminals, and also includes hand-held and fixed user terminals, but not gateways. The GSM system is described in detail in the text The GSM System for Mobile Communications, subtitled A Comprehensive Overview of the European Digital Cellular System, authored by Michel Mouly and Marie-Bernadette Pautet, and published in 1992 by the authors, at 4, rue Elisée Reclus, F-91120 Palaiseau, France. Another text describing the GSM system is Mobile Radio Communications, by Raymond Steele, published 1992 by Pentech Press, London, ISBN 0-7273-1406-8. Each base station of the GSM system includes transmitter and receiver arrangements, and communicates with user terminals by way of signals in a bandwidth of 50 MHz, centered on 900 Mhz., and also by way of signals having a bandwidth of 150 Mhz centered on 1800 Mhz.

A cellular communication system should provide one or more control channels for allowing a user terminal to initially synchronize to the system, and to initiate communications with the overall network. Each base station, fixed site, or tower continually transmits network synchronization information (SCH) and network-specific information (BCCH), which a user terminal uses to synchronize to the appropriate network at initial turn-on of the user terminal. The GSM system provides a channel denominated "Random Access Channel" or RACH. In GSM, the RACH channel is used for initial synchronization of the network to the user terminal.

This invention relates to cellular communications systems, and more particularly to such systems which provide coverage between terrestrial terminals in a region by way of a spacecraft, where some of the terrestrial terminals may be mobile terminals, and some may be gateways which link the cellular system with a terrestrial network such as a public switched telephone network (PSTN).

A salient feature of a spacecraft communication satellite is that all of the electromagnetic transmissions to the user terminals originate from one, or possibly a few, spacecraft. Consequently, the spacecraft communication antenna must form a plurality of beams, each of which is directed toward a different portion of the underlying target region, so as to divide the target area into cells. The cells defined by the beams will generally overlap, so that a user communication terminal may be located in one of the beams, or in the overlap region between two beams, in which case communication between the user communication terminal and the spacecraft is accomplished over one of the beams, generally that one of the beams which provides the greatest gain or signal power to the user terminal. Operation of spacecraft communication systems may be accomplished in many ways, among which is Time-Division Multiple Access, (TDMA), among which are those systems described, for example, in conjunction with U.S. Pat. Nos. 4,641,304, issued Feb. 3, 1987, and 4,688,213, issued Aug. 18, 1987, both in the name of Raychaudhuri. Spacecraft time-division multiple access (TDMA) communication systems are controlled by a controller which synchronizes the transmissions to account for propagation delay between the terrestrial terminals and the spacecraft, as is well known to those skilled in the art of time division multiple access systems. The TDMA control information, whether generated on the ground or at the spacecraft, is ultimately transmitted from the spacecraft to each of the user terminals. Consequently, some types of control signals must be transmitted continuously over each of the beams in order to reach all of the potential users of the system. More specifically, since a terrestrial terminal may begin operation at any random moment, the control signals must be present at all times in order to allow the terrestrial terminal to begin its transmissions or reception (come into time and control synchronism with the communication system) with the least delay.

When the spacecraft is providing cellular service over a large land mass, many cellular beams may be required. In one embodiment of the invention, the number of separate spot beams is one hundred and forty. As mentioned above, each beam carries control signals. These signals include frequency and time information, broadcast messages, paging messages, and the like. Some of these control signals, such as synchronization signals, are a prerequisite for any other reception, and so may be considered to be most important. When the user communication terminal is synchronized, it is capable of receiving other signals, such as paging signals.

Communication spacecraft are ordinarily powered by electricity derived from solar panels. Because the spacecraft may occasionally go into eclipse, the spacecraft commonly includes rechargeable batteries and control arrangements for recharging the batteries when the power available from the solar panels exceeds the power consumed by the spacecraft payload. When a large number of cellular beams are produced by the antenna, a correspondingly large number of control signals must be transmitted from the spacecraft. When one hundred and forty beams are transmitted, one hundred and forty control signals must be transmitted. When the power available from the solar panels is divided between the information and data transmission channels of the spacecraft, the power available to the synchronization and paging signals may be at a level such that a user communication terminal in an open-air location may respond, but a similar terminal located in a building may not respond, due to attenuation of electromagnetic signals by the building.

As illustrated in FIG. 1, spacecraft 12 includes a transmit antenna 12*at* which takes the form, when deployed, of a parabolic reflector 12*atr* and a feed array 12*atf*. Feed array 12*atf* is mounted on the spacecraft body 12*b* at a location near the focus of the parabolic reflector 12*atr*. Similarly, a receive antenna 12*ar* includes a deployed reflector 12*arr* in conjunction with a feed array 12*arf*. In a preferred embodiment of the invention, the feed arrays include an array of feed horns, as described below. Gimbals designated 12*gt* and 12*gr* are mounted at the junctures of spacecraft body 12*b* with reflector supports 12*gts* and 12*gtr*, to allow the reflectors to be moved relative to the feed arrays in order to control the beam direction. A C-band antenna 72 is provided for communication with gateways of a cellular communication system.

FIG. 2 illustrates the layout of the horn apertures of feed horn arrangement 12*atf* of FIG. 1. In FIG. 2, a map of a portion of Asia is superposed on some of the circles representing apertures, distorted to appear as it would from a spacecraft to the East of the Asian coast. More particularly, Asia, together with its principal islands is designated generally as 110, 112 represents India, 114 represents the combination of Vietnam, Cambodia, and Thailand, and 116 represents the island and mainland portions of Malaysia. Some of the islands of Indonesia are represented as 118. New Guinea is illustrated as 120, and Taiwan (Formosa) by 122. The Korean peninsula is 124, and the Japanese islands are represented as 126. The circles, some of which are designated 130, represent the apertures of the various feed horns of the feed array 12*atf* of transmit antenna 12*at* of FIG. 1. Not all of the feed horn apertures are illustrated, because there are eighty-eight feed horn apertures, and illustrating them all would make the illustration difficult to interpret. For the most part, the peripheral horns of the array have been illustrated, together with a line, which is illustrated by the arrows 132, of horns across the region being served. However, it will be understood that the entire continent of Asia, and its offshore islands out as far as the Philippines, are served by spot beams originating from the eighty-eight feed horn apertures which are illustrated, in part, in FIG. 2. More particularly, the feed horn array 12*atf* of FIG. 1 may be represented by the outline of FIG. 2, completely filled in by circles. It should be noted that the circles of FIG. 2 do not represent the spot beam footprints themselves, but may roughly be conceived of as being a version of the footprints which each horn itself would form if it were energized independently, without a beamformer.

FIG. 3 is a more detailed illustration of antenna feed 12*atf* of FIG. 1. As illustrated in FIG. 3, the feed array is made up of a plurality of individual feed horns or cups 310, each of which has hexagonal peripheral walls, for close stacking of the horns in a region illustrated by dash line 312. Dash line 312 outlines a feed-horn region shaped much like the coverage region of FIG. 2. FIG. 4 illustrates one feed antenna 310 of FIG. 3, in the form of an open-ended horn or cup 408. Each feed horn 408, as illustrated in FIG. 4, includes six electrically conductive sides 410*a*, 410*b*, 410*c*, 410*d*, 410*e*, and 410*f*, extending orthogonally above an electrically conductive base or bottom 412. The upper edges of the sides 410*a*, 410*b*, 410*c*, 410*d*, 410*e*, and 410*f* together define an aperture plane 408*p*, better seen in FIG. 5*a*. The horn or cup 408 of FIG. 4 is fed by a conventional crossed dipole illustrated as 420, set in the center of the horn or cup, and supported above the bottom 412 by a combination support and balun 430, well-known in the art. As known to those skilled in the antenna arts, crossed dipole 420 includes a first dipole 420V with two colinear or coaxial elements designated 421 and 422, and a second dipole 420H with two colinear or coaxial elements designated 423 and 424. The balun aspect of support/balun 430 is provided by a pair of slots 432, 434, each having a length of about one-fifth wavelength ($\lambda/5$), or more exactly 0.198 $\lambda$, at the operating frequency, which divide the upper end of the outer shell of support/balun 430 into two portions, designated 430*a* and 430*b*. It should be emphasized that, while the dipoles are designated with V and H suffixes, they are not necessarily oriented in vertical and horizontal directions, as such may have little or no meaning in the context of operation in space. A center conductor 436 is connected by a strap 438 to the near portion 430*b* of the shell. In the arrangement of FIG. 4, the elements 421, 422, 423, and 424 of the two crossed dipoles 420V and 420H lie in the same plane 420*p* (see FIG. 5*b*), and their axial centerlines lie about one-quarter wavelength, or more exactly 0.249 $\lambda$, from the floor or bottom 412. The lengths of the elements of the two dipoles 420V and 420H are made slightly different, so that a quadrature phase shift is introduced between the two dipoles, resulting in generation of circular, or at least elliptical, polarization.

It should be emphasized that antennas are reciprocal transducer devices, which have the same characteristics in both transmission and reception, at least as to impedance at the "feed" point and as to antenna beam pattern and gain. Thus, there is no essential difference between an antenna when used for transmission and reception. However, for historical reasons, the connection to an antenna is termed a "feed" point regardless of whether the antenna is for transmission or for reception. Thus, the term "generation," when referring to the circular or elliptical polarization, applies regardless of whether the antenna is transmitting or receiving circularly or elliptically polarized signals. Also, an antenna seldom transmits or generates exactly circular polarization, it will almost always have some ellipticity. Similarly, even a perfectly circularly polarized signal, if such could be made, transmitted toward a real or practical "circularly" polarized receiving antenna would result in reception of signals which would not be equal in both principal planes.

There is a tradeoff between the power available for transmission over each antenna beam and the total power which is the solar panels 12*s*1 and 12*s*2 of FIG. 1 must produce. The total power which the spacecraft solar panels can produce is limited by the efficiency of the panels, the useful luminous flux in the region of the panels, and the pointing accuracy with which the panels can be oriented to receive the flux. With time, the solar panels may become degraded, as particles penetrate portions of the panels, and the surface of the panels becomes opaque or reflective. In a particular communication system, the communication spacecraft antenna was constructed, and a need for an additional 0.7 dB of effective radiated power or margin manifested itself after the design of the feed antenna. Whatever changes might be required to achieve the required increase in effective radiated power could not add significant weight to the already-designed structure. Since 0.7 dB corresponds to an increase in power of about 18%, the additional margin could not be achieved simply by increasing the transmitted power, because this would have required a corresponding increase in the area of the solar panels, which would have significantly increased the weight.

Attempts were made to achieve the gain increase by modifying the individual horn or cup antennas 310 of the feed arrays 12*atf* and 12*arf* by placing disk-shaped directors before the cup, but this was not successful.

Higher effective radiated power is desired from a feed array.

SUMMARY OF THE INVENTION

An antenna element, suited for use in an antenna array, for operation over a frequency band centered at a particular frequency, includes an electrically conductive hexagonal cup. The hexagonal cup defines six sides of equal length, and a generally flat bottom joining the six sides. The length of each flat side is about thirteen twentieths wavelength at the center frequency. Each of the six sides has a height above the bottom which is a little more than one third wavelength at the particular frequency. A crossed dipole includes first and second dipoles, which together define a dipole plane. The elements of each of the first dipole each have a length of approximately ¼ of the wavelength, so that the length of the first dipole is about half a wavelength. The second dipole has element lengths of about three twentieths wavelength, so that the second dipole length is about four tenths wavelength. In one embodiment, a dipole support is centered in the bottom, and projects above the bottom, for supporting the crossed dipole with the dipole plane parallel to the bottom of the cup, at a distance above the bottom of approximately one-fourth of the wavelength. A feed arrangement is coupled to the crossed dipole, for feeding the first and second dipoles in a band centered at the particular frequency. In order to increase the gain of the elements of the antenna array and improve the axial ratio, a first director ring is provided. The first director ring is of conductive metal, and defines a plane. The first director ring has a diameter of approximately one-quarter of the wavelength, and is mounted with the plane of the first director ring parallel with, and centered on, the bottom of the cup, at a distance of approximately nine-tenths of the wavelength above the bottom. As a result of adding the first director ring, the impedance match of the crossed dipole, as measured at the feed arrangement, may be somewhat degraded. A second director ring of conductive metal is provided. The second director ring defines a plane. The second director ring has a diameter approximately equal to that of the first director ring, and is mounted with the plane of the second director ring parallel with, and centered on, the bottom, at a distance of approximately seven-tenths of the wavelength above the bottom, for improving the matching of the crossed dipole at the feed arrangement. The presence of the second director ring also improves the gain of the antenna over the use of a single director ring.

In a particular embodiment of the invention, each element of the antenna array further includes a mounting arrangement for mounting the first and second director rings. The mounting arrangement comprises a dielectric structure including a cylindrical portion, and also including a dielectric tripod portion projecting above the bottom of the cup. The dielectric tripod portion of the mounting arrangement includes first, second, and third feet. Each of the first, second, and third feet is coupled to an alternate one of the apices defined by the six sides of the cup. The dielectric tripod portion also includes a circular aperture centered between the upper ends of the first, second and third feet. The dielectric cylindrical portion has an outer diameter dimensioned to fit snugly within the circular aperture and within the first and second director rings. The cylindrical portion is mounted within the circular aperture, with the circular aperture surrounding the cylindrical portion at a location midway between the ends of the cylindrical portion, and with the first and second director rings affixed to the cylindrical portion near the ends thereof. The tripod portion may be made from reinforced polymer. The first and second director rings may have a thickness, measured in a direction parallel to a line joining the centers of the first and second director rings, which is approximately 0.01 of the wavelength.

DESCRIPTION OF THE INVENTION

Figure 1:
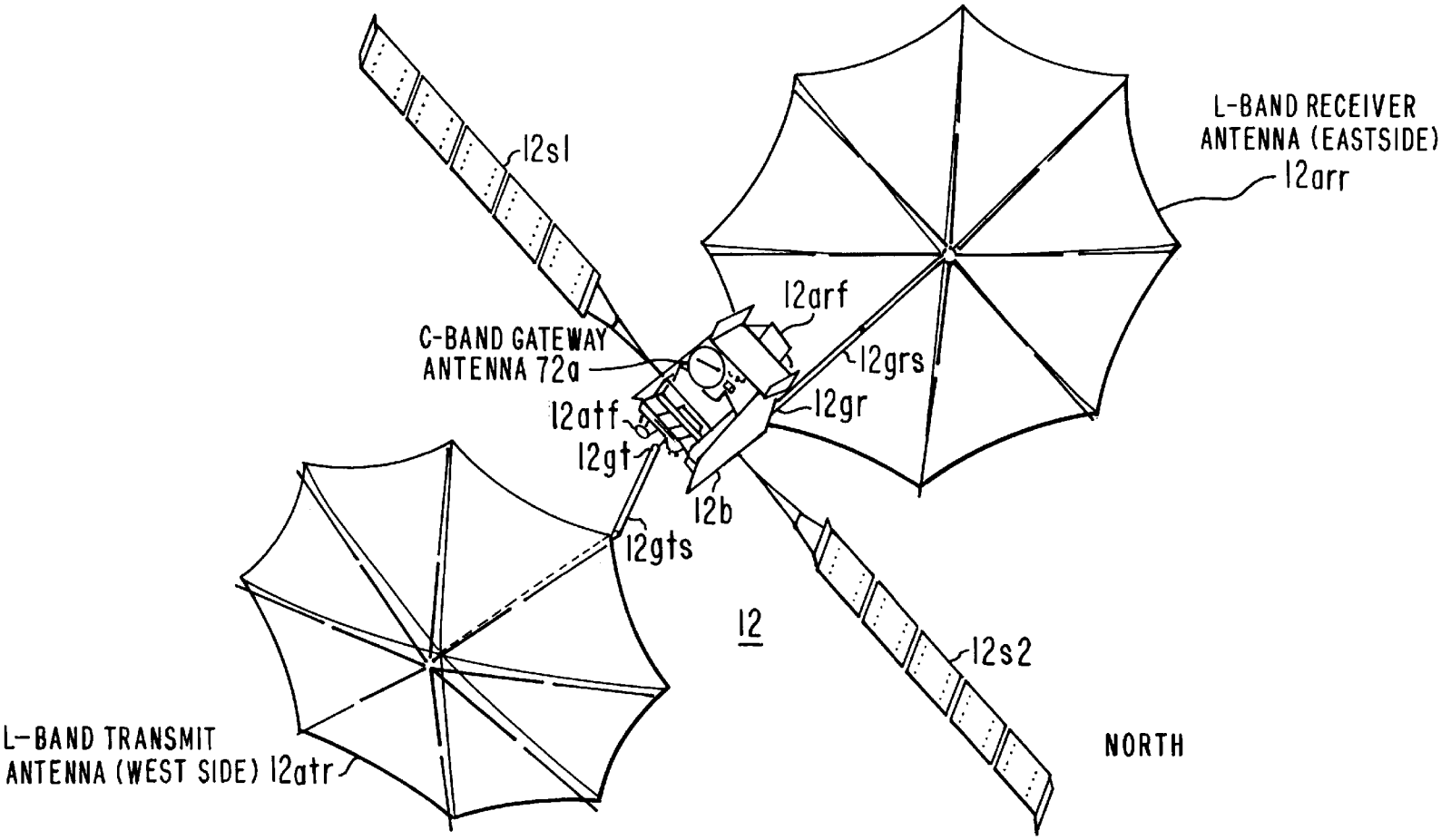
FIG. 1 is a perspective or isometric view of a spacecraft with reflector-type antennas and array feeds.
Figure 2:
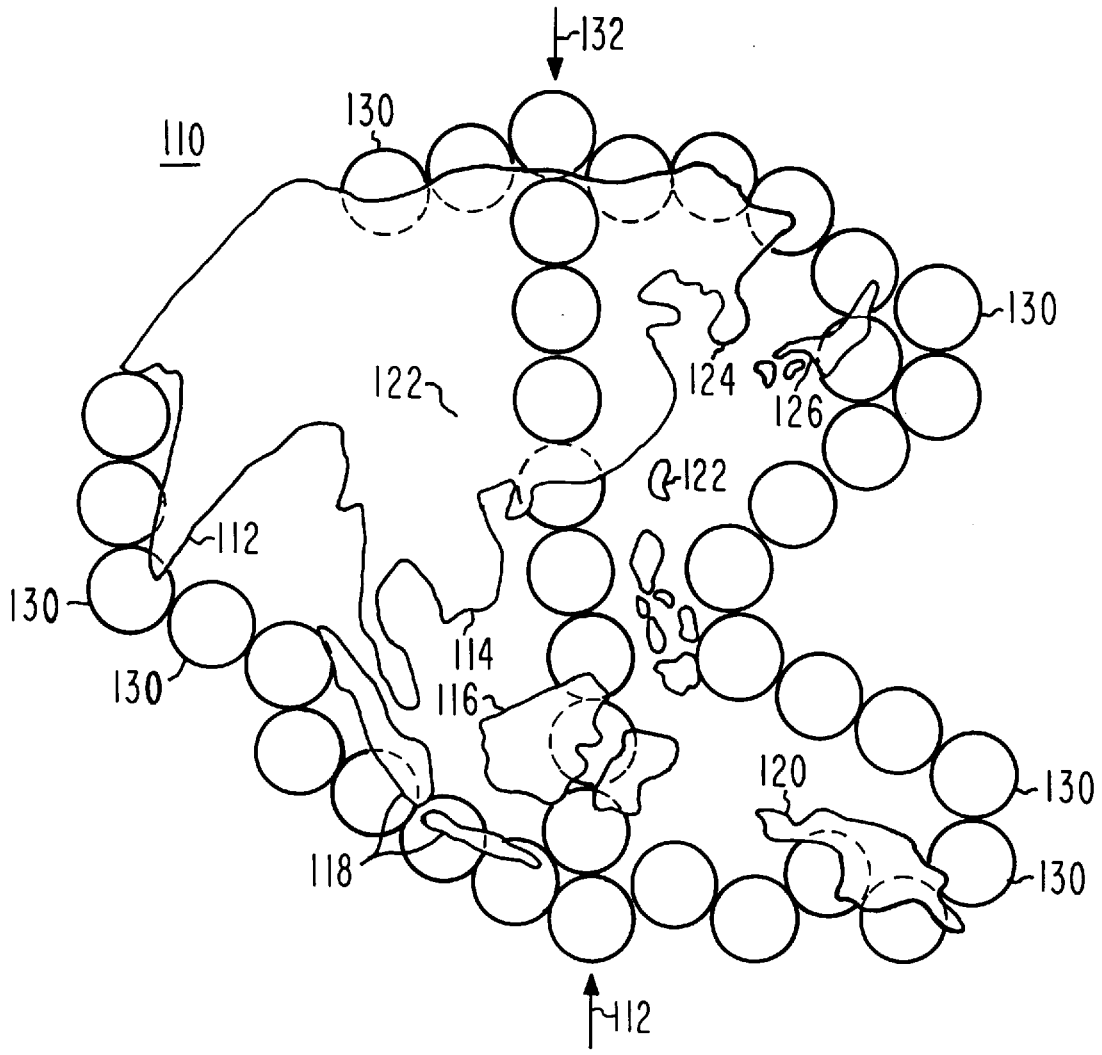
FIG. 2 is a simplified illustration of the feed array, superposed over a map of Asia as seen from the spacecraft.
Figure 3:
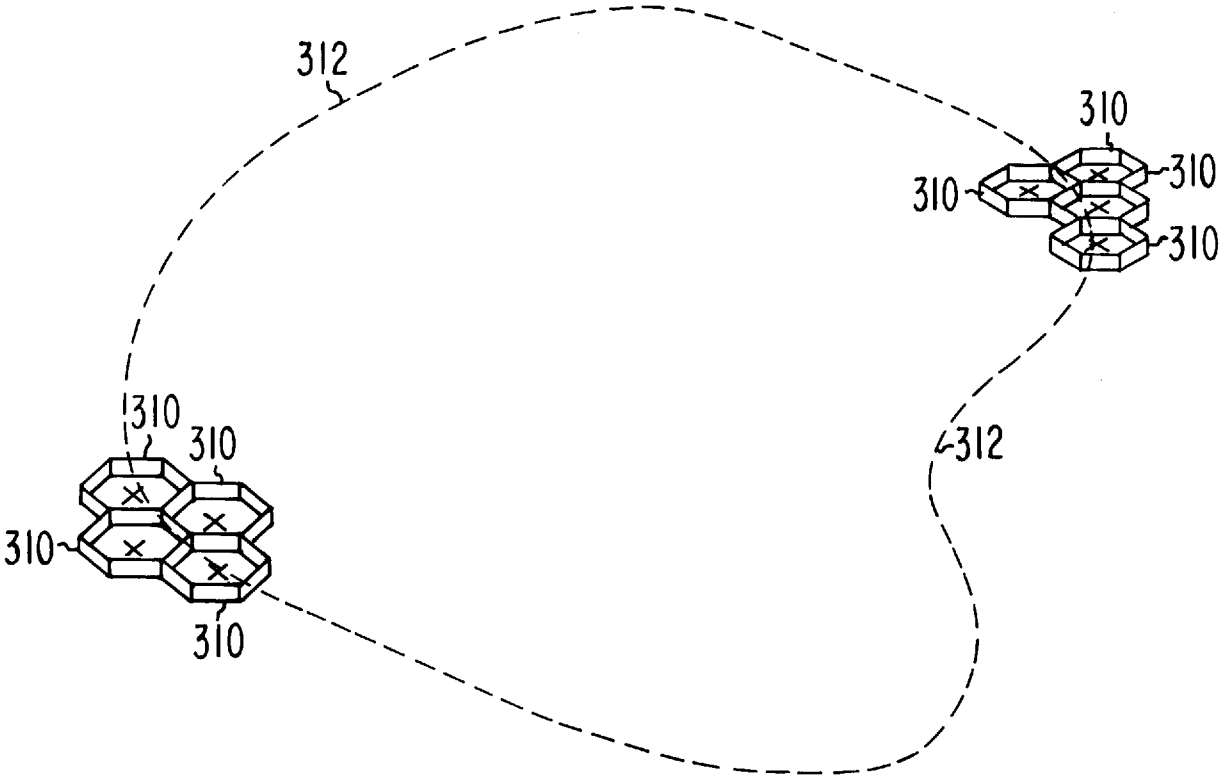
FIG. 3 is a simplified perspective or isometric view of a feed array including a plurality of hexagonal horns or cups, each of which is fed by a crossed dipole.
Figure 4:
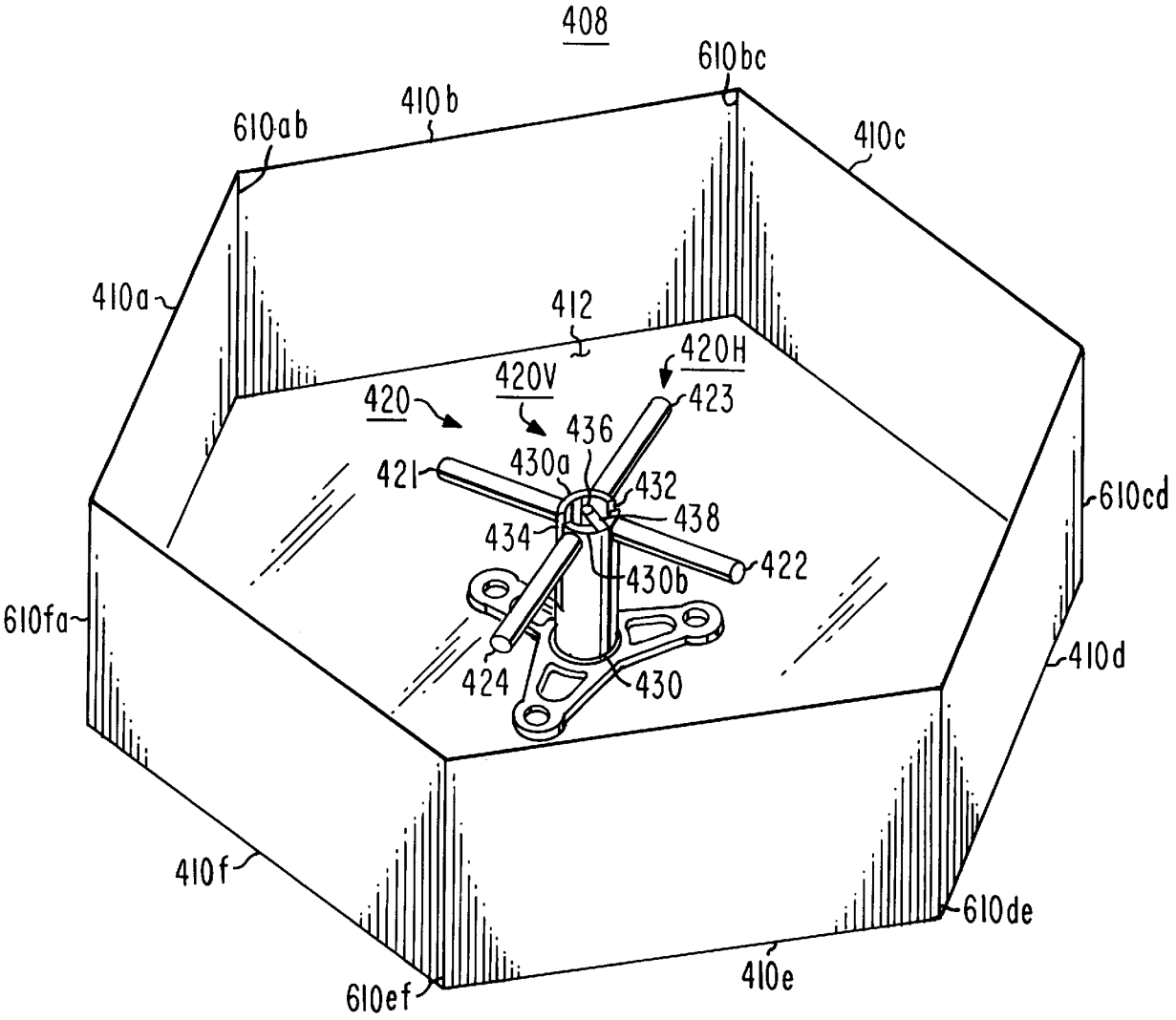
FIG. 4 is a simplified perspective or isometric view of a single feed horn or cup of the array of FIG. 3.
Figure 5A:
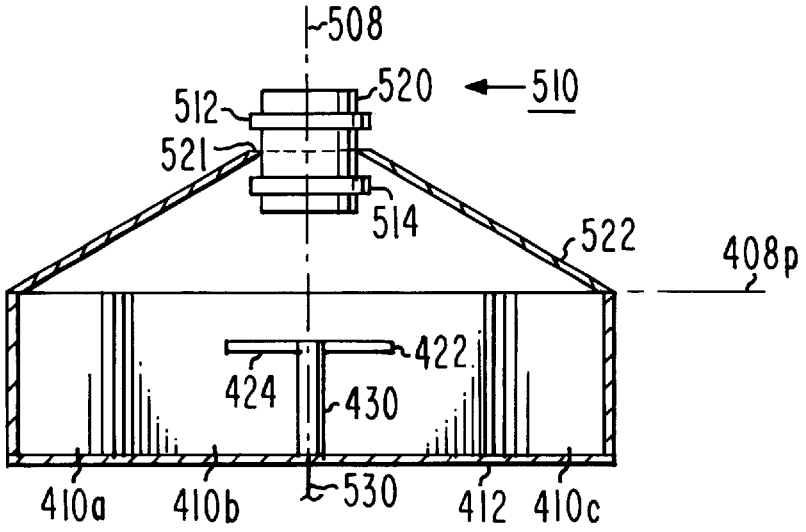
FIG. 5*a* is a simplified cross-sectional view of the individual horn or cup antenna of FIG. 4, including structure according to an aspect of the invention.
Figure 5B:
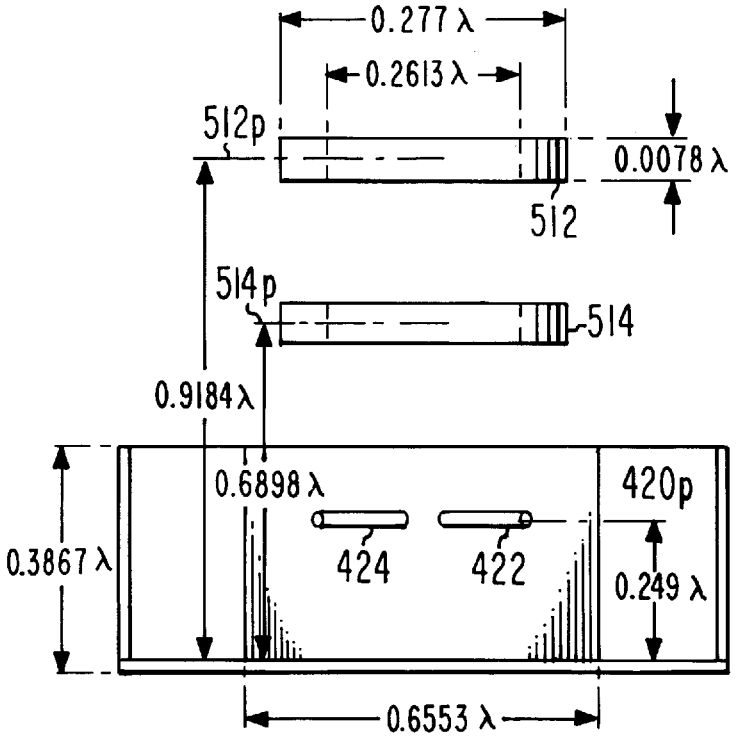
FIG. 5*b* illustrates various planes and dimensions in free-space wavelengths.

FIG. 5*a* illustrates a single feed element, similar to that of FIG. 4, of the array of FIG. 3, modified in accordance with an aspect of the invention by addition of a director arrangement 510. FIG. 5*b* is simplified, and shows the dimensions of the elements in free-space wavelengths at the center of the frequency of operation. In FIG. 5*a*, director arrangement 510 includes a first electrically conductive ring or annulus 512, which has an inner diameter of 0.2613 λ, an outer diameter of 0.277 λ, an axial length in the direction of longitudinal axis 508 of 0.0078 λ, and is located coaxial with the suppot/balun 430, centered at a distance of A 0.9184 λ above the floor or bottom 412 of the horn or cup 310. The presence of first ring 512 increases the gain of the horn or cup antenna 310 alone, but degrades the impedance match as seen at a feed cable 530 feeding the support/balun 430. The impedance match is improved by addition of a second electrically conductive ring 514, coaxial with ring 512. The dimensions of ring 514 are the same as those cenring 512. The second ring 514 is centered at a height of 0.6898 λ above floor or bottom 512 of horn or cup 310.

The pair of first and second rings 512, 514 is supported above the open end of the horn or cup 310 by the combination of two thin dielectric support elements. The rings 512 and 514 are mounted on the exterior of a dielectric cylinder 520. Dielectric cylinder 520, in turn, is supported at a location 521 between it upper and lower edges by a thin dielectric tripod 522. Tripod 522 has three feet connecting to the top of the junctures of walls 410 of the horn or cup, as illustrated in more detail in FIG. 6.

Figure 6:
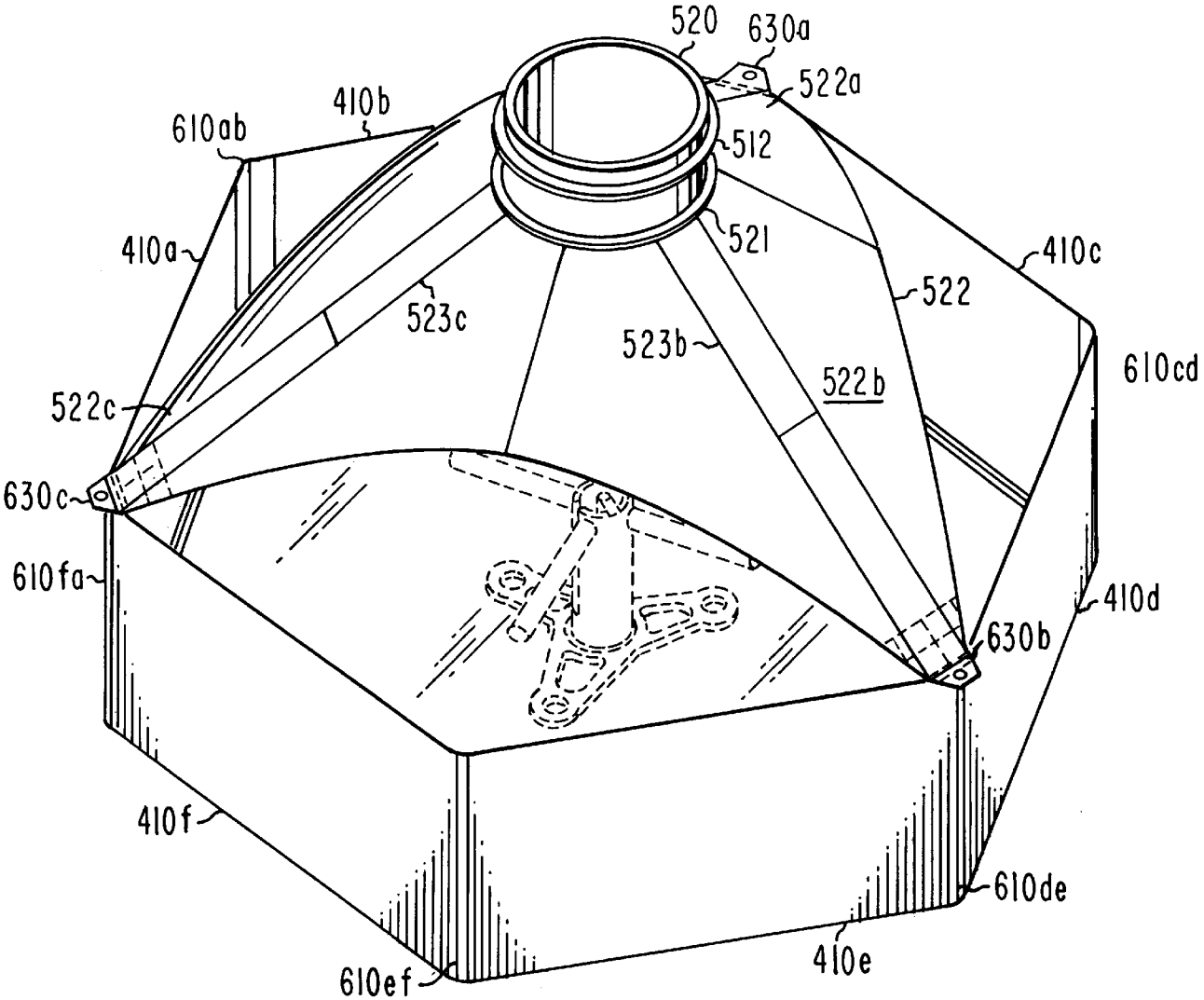
FIG. 6 is a simplified perspective or isometric view of the assembly of FIG. 5*a;*

In FIG. 6, elements corresponding to those of FIGS. 4, 5*a*, and 5*b* are designated by like reference numerals. In FIG. 6, tripod 522 connects to location 521 of cylinder 520 at a location below ring 512, and ring 514 cannot be seen, being below a portion of tripod 522. Tripod 522 includes three legs, namely legs 522*a*, 522*b*, and 522*c*. Leg 522*a* of tripod 522 is fastened by a tab 630 to the upper portion of the junction, juncture or corner of walls 410*b* and 410*c*, leg 522*b* of tripod 522 is fastened to the upper portion 610*de* of the junction of walls 410*d* and 410*e*, and leg 522*c* of tripod 522 is fastened to the upper portion 610*fa* of the junction of walls 410*f* and 410*a*. The connections may be made by plastic screws extending into existing holes. Tripod 522 is made from a thin KEVLAR fabric, reinforced with cured epoxy. A double-layer reinforcement is illustrated on tripod leg 522*b* as 523*b*, and a similar reinforcement on leg 522*c* is illustrated as 523*c*. Leg 522*a* also has such a reinforcement, but it is not clearly visible in FIG. 6.

Figure 7:
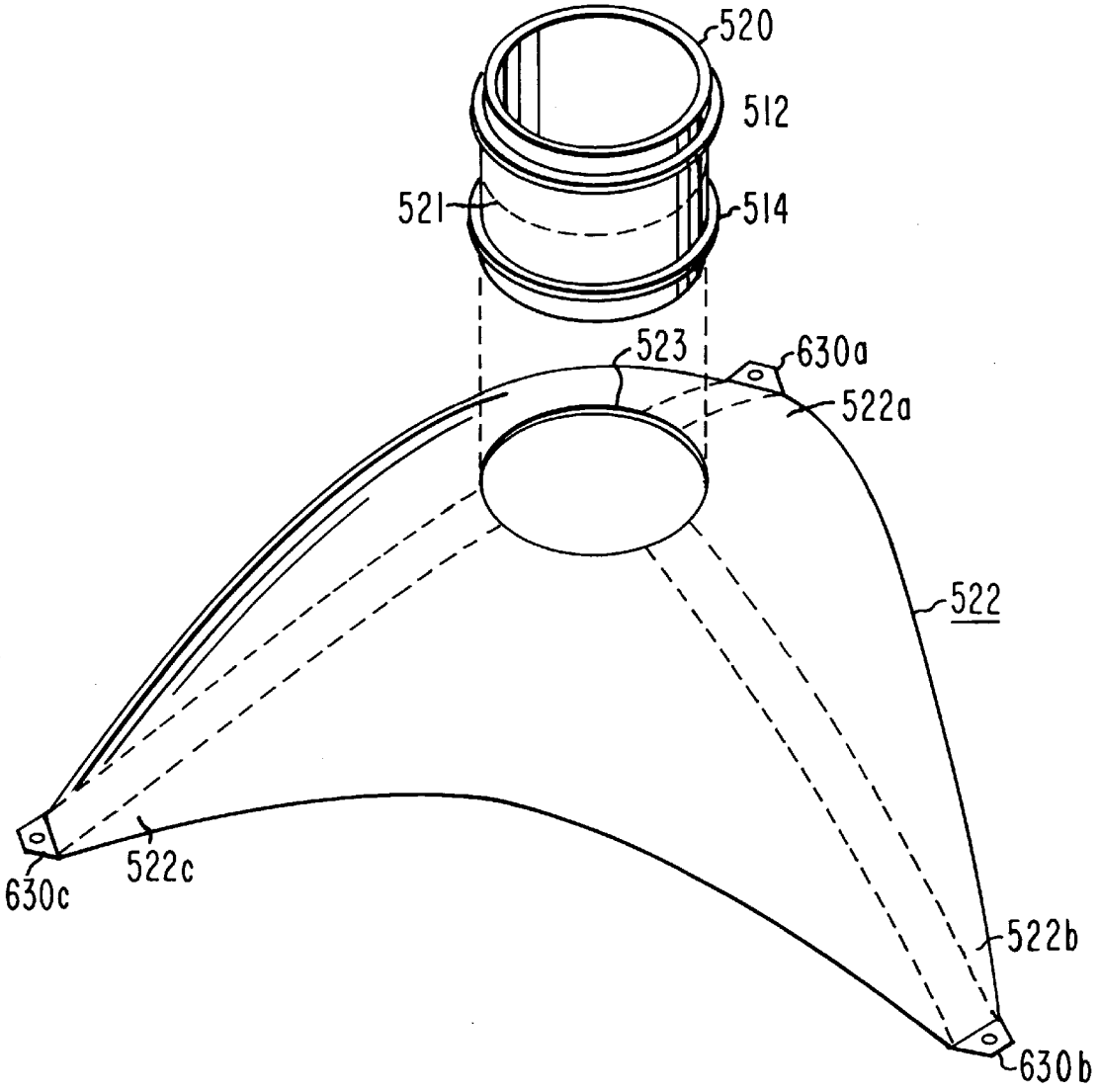
FIG. 7 is a simplified perspective or isometric view of the support tripod exploded away from the support cylinder.

FIG. 7 is a view of the tripod portion 522 of the arrangement of FIG. 6, exploded away from the cylindrical portion 520.

The arrangement according to the invention increases the effective gain of the individual horn or cup antenna by 0.7 db, and also has the effect of improving the axial ratio of the elliptical polarization.

Figure 8:
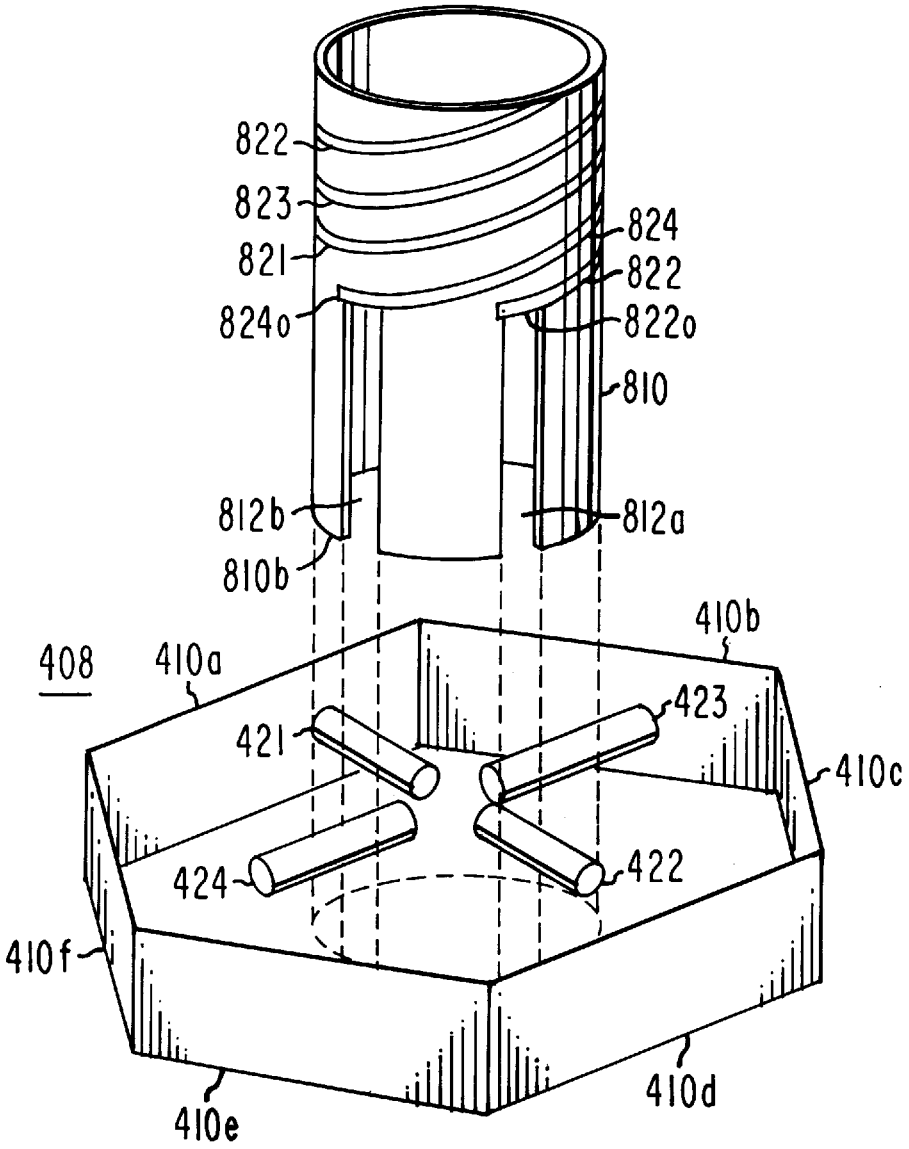
FIG. 8 is a perspective or isometric view of another arrangement which was considered as a solution to the requirement for increased gain.

FIG. 8 is a perspective or isometric view of another arrangement considered for increasing the gain of the individual cup or horn antennas of the feed array. In FIG. 8, elements corresponding to those of FIG. 4 are designated by like reference numerals. In FIG. 8, the cup with its walls 410*a*, 410*b*, 410*c*, 410*d*, 410*e*, 410*f*, and its bottom 412 is shown in its entirety, but only the elements 421, 422, 423, and 424 of the crossed dipole are illustrated. A thin-wall dielectric cylinder 810 has a plurality of slots, of which slots 812*a* and 812*b* are visible. Slot 812*a* is registered with antenna element 422, and slot 812*b* is registered with antenna element 424. Other slots, not visible in FIG. 8, are registered with antenna elements 421 and 423. The slots in cylinder 810 which are registered with antenna elements are deep enough so that, when cylinder 810 is slipped over the antenna elements, the base 810*b* of cylinder 810 rests on the bottom 412 of the horn or cup 408, with the top edge of each slot close to the associated antenna element. As also illustrated in FIG. 8, an electrical conductor 822 extends helically around the dielectric cylinder 810 from an origin location 822*o*. Origin location 822*o* of helical conductor 822 is selected at the top edge of slot 812*a* to provide electromagnetic coupling from the linear antenna element 422 into the helical conductor 822. Similarly, an electrical conductor 824 extends helically around the dielectric cylinder 810 from an origin location 824*o*. Origin location 824*o* of helical conductor 824 is selected at the top edge of slot 812*b* to provide electromagnetic coupling from the linear antenna element 424 into the helical conductor 824. Additional conductors illustrated as 821 and 823 wind around the cylinder in like manner, and each terminates adjacent the upper edge of a slot corresponding to slots 812*a* and 812*b*, to couple to antenna elements 421 and 423, respectively. The helical windings project above the aperture plane defined by the upper edges of the walls 410*a*, 410*b*, 410*c*, 410*d*, 410*e*, 410*f* of the horn or cup 408, to improve the gain of the basic antenna element 408.

Figure 9:
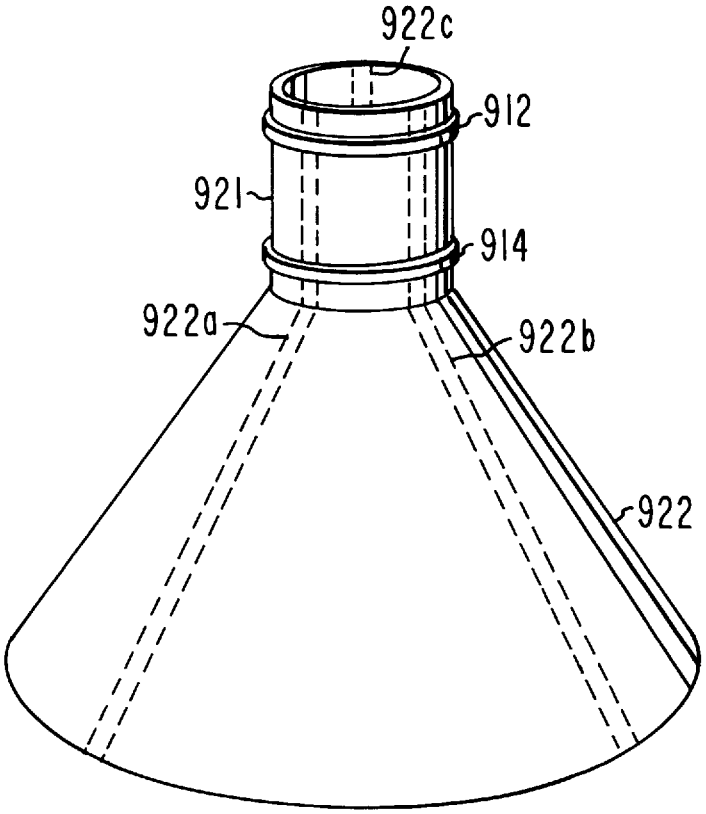
FIG. 9 is a perspective or isometric view of another dielectric support for the director rings.

FIG. 9 is a perspective or isometric view of another dielectric support for the director rings. In FIG. 9, the dielectric support is KEVLAR fabric reinforced polymer, with a conical base 922, and upstanding cylinder 921. The director rings are illustrated as 912 and 914. Reinforced sections are illustrated as 922*a*, 922*b*, and 922*c*.

Thus, according to the invention, an antenna element (310), suited for use in an antenna array (12*atf*, 12*arf*), for operation over a frequency band centered at a particular frequency, includes an electrically conductive hexagonal cup (408). The hexagonal cup (408) defines six sides (410*a*, 410*b*, 410*c*, 410*d*, 410*e*, 410*f*) of equal length, and a generally flat bottom (412) joining the six sides (410*a*, 410*b*, 410*c*, 410*d*, 410*e*, 410*f*). The length of each flat side (410*a*, 410*b*, 410*c*, 410*d*, 410*e*, 410*f*) is 0.6553 λ, or about thirteen twentieths λ. Each of the six sides (410*a*, 410*b*, 410*c*, 410*d*, 410*e*, 410*f*) has a height above the bottom (412) which is 0.3867 λ, or a little more than one-third wavelength at the particular frequency. A crossed dipole (420) includes first (420V) and second (420H) dipoles, which together define a dipole plane. The elements (421, 422) of the first (420V) dipole each have a length of approximately ¼ of the wavelength (0.258 λ), so that the total length of the first dipole (420V) is 0.586 λ, or about one-half wavelength. The elements (423, 424) of the second dipole (420H) each have a length of 0.144 λ, or about three twentieths λ, so that the second dipole (420H) has a length of 0.376 λ, or about four tenths λ. In one embodiment, a dipole support (430) is centered in the bottom, and projects above the bottom (412), for supporting the crossed dipole (420) with the dipole plane (420*p*) parallel to the bottom of the cup (408), at a distance above the bottom (412) of 0.249 λ, or approximately one-quarter of the wavelength. A feed arrangement (430, 430*a*, 430*b*, 432, 434, 438) is coupled to the crossed dipole (420), for feeding the first (420V) and second (420H) dipoles in a band centered at the particular frequency. In order to increase the gain of the elements of the antenna array (12*atf*, 12*arf*) and improve the axial ratio, a first director ring (512) is provided. The first director ring (512) is of conductive metal, and defines a plane (512*p*). The first director ring (512) has a diameter of 0.269 λ, or approximately one-quarter of the wavelength, and is mounted with the plane (512*p*) of the first director ring (512) parallel with, and centered on, the bottom (412) of the cup (408), at a distance of 0.9184 λ, or approximately nine-tenths of the wavelength above the bottom (412). As a result of adding the first director ring (512), the impedance match of the crossed dipole (420), as measured at the feed arrangement (530), may be somewhat degraded. A second director ring (514) of conductive metal is provided. The second director ring (514) defines a plane (514*p*). The second director ring (514) has a diameter of 0.269 λ, or approximately one-quarter of the wavelength, and is mounted with the plane (514*p*) of the second director ring (514) parallel with, and centered on (axis 508), the bottom (412), at a distance of 0.6898 λ, or approximately seven-tenths of the wavelength above the bottom (412), for improving the matching of the crossed dipole (420) at the feed arrangement (530).

In a particular embodiment of the invention, each element (310) of the antenna array (12*atf*, 12*arf*) further includes a mounting arrangement (520, 522) for mounting the first (512) and second (514) director rings. The mounting arrangement (520, 522) comprises a dielectric structure including a cylindrical portion (520), and also including a dielectric tripod portion (522) projecting above the bottom (412) of the cup (408). The dielectric tripod portion (522) of the mounting arrangement (520, 522) includes first (522*a*), second (522*b*), and third (522*c*) feet. Each of the first (522*a*), second (522*b*), and third (522*c*) feet is coupled to an alternate one (610*bc*, 610*de*, 610*fa*) of the apices (610*ab*, 610*bc*, 610*cd*, 610*de*, 610*ef*, 610*fa*) defined by the six sides (410*a*, 410*b*, 410*c*, 410*d*, 410*e*, 410*f*) of the cup (408). The dielectric tripod portion (522) also includes a circular aperture (523) centered between the upper ends of the first (522*a*), second (522*b*) and third (522*c*) feet. The dielectric cylindrical portion (520) has an outer diameter dimensioned to fit snugly within the circular aperture (523) and within the first (512) and second (514) director rings. The cylindrical portion (520) is mounted within the circular aperture (523), with the circular aperture (523) surrounding the cylindrical portion (520) at a location (521) midway between the ends **(520*t*, 520*b*) of the cylindrical portion (520), and with the first (512) and second (514) director rings affixed to the cylindrical portion (520) near the ends (520*t*, 520*b*) thereof. The tripod portion (522) may be made from reinforced polymer. The first (512) and second (514) director rings may have a thickness, measured in a direction parallel to a line (508) joining the centers of the first (512) and second (514)** director rings, which is 0.0078 λ, or approximately one one-hundredth of the wavelength.

Other embodiments of the invention will be apparent to those skilled in the art. For example, while the rings 514, 516 have been described as being mounted on the exterior of the dielectric cylinder 520, they may be mounted on the interior of the cylinder. The rings may be plated onto the cylinder, or they may be separately fabricated and placed on the cylinder. Instead of the illustrated large-diameter dielectric supports, the director rings may be supported by a simple cylinder which extends to the base of the cup, with slots cut into the dielectric cylinder to clear the dipole elements.

What is claimed is:

1. An element of an antenna array suitable for use over a frequency band centered at a particular frequency corresponding to a particular wavelength, comprising:

an electrically conductive hexagonal cup defining six sides of equal length, and also defining a generally flat bottom joining said six sides;

a crossed dipole including first and second dipoles together defining a dipole plane, said first dipole having at least one element each having a length of about one-quarter of said wavelength, and said second dipole having at least one element, each having a length of approximately three twentieths of said wavelength;

a dipole support centered in said bottom, for supporting said crossed dipole with said plane parallel to said bottom of said cup, at a distance above said bottom of approximately one-quarter of said wavelength;

feed means coupled to said crossed dipole, for feeding said first and second dipoles at said frequency;

a first director ring of conductive metal defining a plane, said first director ring having a diameter of approximately one-quarter of said wavelength, and being mounted with said plane of said first director ring parallel with, and centered on, said bottom, at a distance of approximately nine-tenths of said wavelength above said bottom, for increasing the gain of said element of said array antenna at said particular frequency, and for improving the axial ratio, whereby the impedance match of said crossed dipole as measured at said feed means may be somewhat degraded; and a second director ring of conductive metal defining a plane, said second director ring having a diameter of approximately one-quarter of said wavelength, and being mounted with said plane of said second director ring parallel with, and centered on, said bottom, at a distance of approximately seven-tenths of said wavelength above said bottom, for improving the matching of said crossed dipole at said feed means.

2. An element of an antenna array according to claim 1, in which:

the elements of said first dipole each have a length of about 0.250 of said wavelength, and said second dipole elements have a length of approximately 0.144 of said wavelength;

said dipole support supports said crossed dipole with said plane parallel of said crossed dipole at a distance above said bottom of approximately 0.249 of said wavelength;

said first director ring has a diameter of approximately 0.269 of said wavelength, and is at a distance of approximately 0.9184 of said wavelength above said bottom; and said second director ring has a diameter of approximately 0.269 of said wavelength, and is mounted with said plane of said second director ring at a distance of approximately 0.6898 of said wavelength above said bottom.

3. An element of an antenna array according to claim 1, further comprising mounting means for mounting said first and second director rings, said mounting means comprising:

a dielectric structure including a cylindrical portion, and also including a dielectric tripod portion projecting above said bottom of said cup;

said dielectric tripod portion including first, second, and third feet, each of said first, second, and third feet being coupled to an alternate one of the apices defined by said six sides of said cup, and also including a circular aperture centered between the upper of said first, second and third feet; and a dielectric cylinder having an outer diameter dimensioned to fit snugly within said circular aperture and within said first and second director rings, said dielectric cylinder being mounted within said circular aperture, with said circular aperture surrounding said dielectric cylinder at a location midway between the ends of said dielectric cylinder, and with said first and second director rings affixed to said dielectric cylinder near said ends thereof.

4. An element of an antenna array according to claim 3, wherein said dielectric tripod and said dielectric cylinder are made from reinforced polymer.

5. An element of an antenna array according to claim 1, wherein said first and second director rings have a thickness, measured in a direction parallel to a line joining the centers of said first and second director rings, which is approximately one one-hundredth of said wavelength.

6. An element of an antenna array according to claim 1, wherein said length of each of said sides of said hexagonal cup is about thirteen twentieths of a wavelength at said particular frequency, and wherein each of said six sides has a height above said bottom which is approximately one-third wavelength at said particular frequency.

7. An antenna array suitable for use over a frequency band centered at a particular frequency corresponding to a particular wavelength, and including a plurality of elements, each of said elements of said antenna array comprising:

an electrically conductive hexagonal cup defining six sides of equal length, and also defining a generally flat bottom joining said six sides;

a crossed dipole including first and second dipoles together defining a dipole plane, the elements of each of said first dipole each having a length of about one-quarter of said wavelength, and said second dipole having elements having a length of approximately three twentieths of said wavelength;

a dipole support centered in said bottom, for supporting said crossed dipole with said plane parallel to said bottom of said cup, at a distance above said bottom of approximately one-quarter of said wavelength;

feed means coupled to said crossed dipole, for feeding said first and second dipoles at said frequency;

a first director ring of conductive metal defining a plane, said first director ring having a diameter of approximately one-quarter of said wavelength, and being mounted with said plane of said first director ring parallel with, and centered on, said bottom, at a distance of approximately nine-tenths of said wavelength above said bottom, for increasing the gain of said elements of said array antenna at said particular frequency, and for improving the axial ratio, whereby the impedance match of said crossed dipole as measured at said feed means may be somewhat degraded; and a second director ring of conductive metal defining a plane, said second director ring having a diameter of approximately one-quarter of said wavelength, and being mounted with said plane of said second director ring parallel with, and centered on, said bottom, at a distance of approximately seven-tenths of said wavelength above said bottom, for improving the matching of said crossed dipole at said feed means.

8. An antenna array according to claim 7, wherein the elements of said first dipole each have a length of about 0.250 of said wavelength, and said second dipole has elements having a length of approximately 0.144 of said wavelength;

said dipole support supports said crossed dipole with said plane parallel of said crossed dipole at a distance above said bottom of approximately 0.249 of said wavelength;

said first director ring has a diameter of approximately 0.269 of said wavelength, and is at a distance of approximately 0.9184 of said wavelength above said bottom; and said second director ring has a diameter of approximately 0.269 of said wavelength, and is mounted with said plane of said second director ring at a distance of approximately 0.6898 of said wavelength above said bottom.

9. An element of an antenna array according to claim 7, further comprising mounting means for mounting said first and second director rings, said mounting means comprising:

a dielectric structure including a cylindrical portion, and also including an upwardly projecting dielectric tripod portion;

said dielectric tripod portion including first, second, and third feet, each of said first, second, and third feet being coupled to an alternate one of the apices defined by said six sides of said cup, and also including a circular aperture centered between the uppermost ends of said first, second and third feet; and a dielectric cylinder having an outer diameter dimensioned to fit snugly within said circular aperture and within said first and second director rings, said dielectric cylinder being mounted within said circular aperture, with said circular aperture surrounding said dielectric cylinder at a location midway between the ends of said dielectric cylinder, and with said first and second director rings affixed to said dielectric cylinder near said ends thereof.

10. An element of an antenna array according to claim 9, wherein said dielectric tripod and said dielectric cylinder are made from reinforced polymer.

11. An element of an antenna array according to claim 7, wherein said first and second director rings have a thickness, measured in a direction parallel to a line joining the centers of said first and second director rings, which is approximately one one-hundredth of said wavelength.

12. A spacecraft including at least one antenna array, said antenna array being suitable for use over a frequency band centered at a particular frequency corresponding to a particular wavelength, and including a plurality of elements, each of said elements of said antenna array comprising:

an electrically conductive hexagonal cup defining six sides of equal length, and also defining a generally flat bottom joining said six sides;

a crossed dipole including first and second dipoles together defining a dipole plane, the elements of each of said first dipole each having a length of about one-quarter of said wavelength, and said second dipole having elements having a length of approximately three twentieths of said wavelength;

a dipole support centered in said bottom, for supporting said crossed dipole with said plane parallel to said bottom of said cup, at a distance above said bottom of approximately one-quarter of said wavelength;

feed means coupled to said crossed dipole, for feeding said first and second dipoles at said frequency;

a first director ring of conductive metal defining a plane, said first director ring having a diameter of approximately one-quarter of said wavelength, and being mounted with said plane of said first director ring parallel with, and centered on, said bottom, at a distance of approximately nine-tenths of said wavelength above said bottom, for increasing the gain of said elements of said array antenna at said particular frequency, and for improving the axial ratio, whereby the impedance match of said crossed dipole as measured at said feed means may be somewhat degraded; and a second director ring of conductive metal defining a plane, said second director ring having a diameter of approximately one-quarter of said wavelength, and being mounted with said plane of said second director ring parallel with, and centered on, said bottom, at a distance of approximately seven-tenths of said wavelength above said bottom, for improving the matching of said crossed dipole at said feed means.

13. An element of an antenna array according to claim 12, in which:

the elements of said first dipole each have a length of about 0.250 of said wavelength, and said second dipole has elements having a length of approximately 0.144 of said wavelength;

said dipole support supports said crossed dipole with said plane parallel of said crossed dipole at a distance above said bottom of approximately 0.249 of said wavelength;

said first director ring has a diameter of approximately 0.269 of said wavelength, and is at a distance of approximately 0.9184 of said wavelength above said bottom; and said second director ring has a diameter of approximately 0.269 of said wavelength, and is mounted with said plane of said second director ring at a distance of approximately 0.6898 of said wavelength above said bottom.

14. An element of an antenna array according to claim 12, further comprising mounting means for mounting said first and second director rings, said mounting means comprising:

a dielectric structure including a cylindrical portion, and also including a dielectric tripod portion projecting above said bottom of said cup;

said dielectric tripod portion including first, second, and third feet, each of said first, second, and third feet being coupled to an alternate one of the apices defined by said six sides of said cup, and also including a circular aperture centered between the upper of said first, second and third feet; and a dielectric cylinder having an outer diameter dimensioned to fit snugly within said circular aperture and within said first and second director rings, said dielectric cylinder being mounted within said circular aperture, with said circular aperture surrounding said dielectric cylinder at a location midway between the ends of said dielectric cylinder, and with said first and second director rings affixed to said dielectric cylinder near said ends thereof.

15. An element of an antenna array according to claim 14, wherein said dielectric tripod and said dielectric cylinder are made from reinforced polymer.

16. An element of an antenna array according to claim 12, wherein said first and second director rings have a thickness, measured in a direction parallel to a line joining the centers of said first and second director rings, which is approximately one one-hundredth of said wavelength.

17. An element of an antenna array according to claim 12, wherein said length of each of said sides of said hexagonal cup is about thirteen twentieths of a wavelength at said particular frequency, and wherein each of said six sides has a height above said bottom which is approximately one-third wavelength at said particular frequency.

* * * * *